US010551778B2

(12) United States Patent
Watatani

(10) Patent No.: US 10,551,778 B2
(45) Date of Patent: Feb. 4, 2020

(54) FIXING DEVICE ENHANCING HEAT INSULATION PERFORMANCE AND IMAGE FORMING APPARATUS INCLUDING THE SAME

(71) Applicant: KYOCERA Document Solutions Inc., Osaka (JP)

(72) Inventor: Tomohiro Watatani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/270,385

(22) Filed: Feb. 7, 2019

(65) Prior Publication Data

US 2019/0265621 A1 Aug. 29, 2019

(30) Foreign Application Priority Data

Feb. 27, 2018 (JP) ..... 2018-033669

(51) Int. Cl.
*G03G 15/20* (2006.01)

(52) U.S. Cl.
CPC ..... *G03G 15/2053* (2013.01); *G03G 15/2017* (2013.01); *G03G 15/2039* (2013.01); *G03G 2215/2035* (2013.01)

(58) Field of Classification Search
CPC ..... G03G 15/2039; G03G 15/2053; G03G 21/1685; G03G 2215/20; G03G 2215/2003; G03G 2221/1639; G03G 15/2017; G03G 2215/2035
See application file for complete search history.

(56) References Cited

U.S. PATENT DOCUMENTS

2013/0302073 A1* 11/2013 Takeuchi ..... G03G 15/2039 399/328
2015/0268606 A1* 9/2015 Hayase ..... G03G 15/2053 399/330
2015/0268607 A1* 9/2015 Hayase ..... G03G 15/2053 399/330
2016/0357144 A1* 12/2016 Saito ..... G03G 15/2039
2016/0363894 A1* 12/2016 Omata ..... G03G 15/2053

FOREIGN PATENT DOCUMENTS

JP 2009-229839 A 10/2009

* cited by examiner

*Primary Examiner* — Sophia S Chen
(74) *Attorney, Agent, or Firm* — Studebaker & Brackett PC

(57) ABSTRACT

A fixing device includes a fixing member, a fixing frame and an upper cover. The fixing member is configured to rotate around a rotation axis extending along one direction and configured to fix a toner image on a recording medium. The fixing frame is configured to cover an upper side of the fixing member. The upper cover is configured to cover an upper side of the fixing frame. An air layer for heat insulation is formed between the fixing frame and the upper cover.

9 Claims, 6 Drawing Sheets

FIXING DEVICE ENHANCING HEAT INSULATION PERFORMANCE AND IMAGE FORMING APPARATUS INCLUDING THE SAME

INCORPORATION BY REFERENCE

This application is based on and claims the benefit of priority from Japanese patent application No. 2018-033669, filed on Feb. 27, 2018, which is incorporated by reference in its entirety.

BACKGROUND

The present disclosure relates to a fixing device configured to fix a toner image on a recording medium and an image forming apparatus including the fixing device.

An image forming apparatus, such as a copying machine, a printer, and a facsimile, includes a fixing device configured to fix a toner image on a recording medium, such as a sheet. The fixing device includes a fixing member configured to fix the toner image on the recording medium and a cover configured to cover an upper side of the fixing member, for example.

SUMMARY

In accordance with an aspect of the present disclosure, a fixing device includes a fixing member, a fixing frame and an upper cover. The fixing member is configured to rotate around a rotation axis extending along one direction and configured to fix a toner image on a recording medium. The fixing frame is configured to cover an upper side of the fixing member. The upper cover is configured to cover an upper side of the fixing frame. An air layer for heat insulation is formed between the fixing frame and the upper cover.

In accordance with an aspect of the present disclosure, an image forming apparatus includes the fixing device.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

First, an entire structure of an image forming apparatus 1 will be described.

Figure 1:
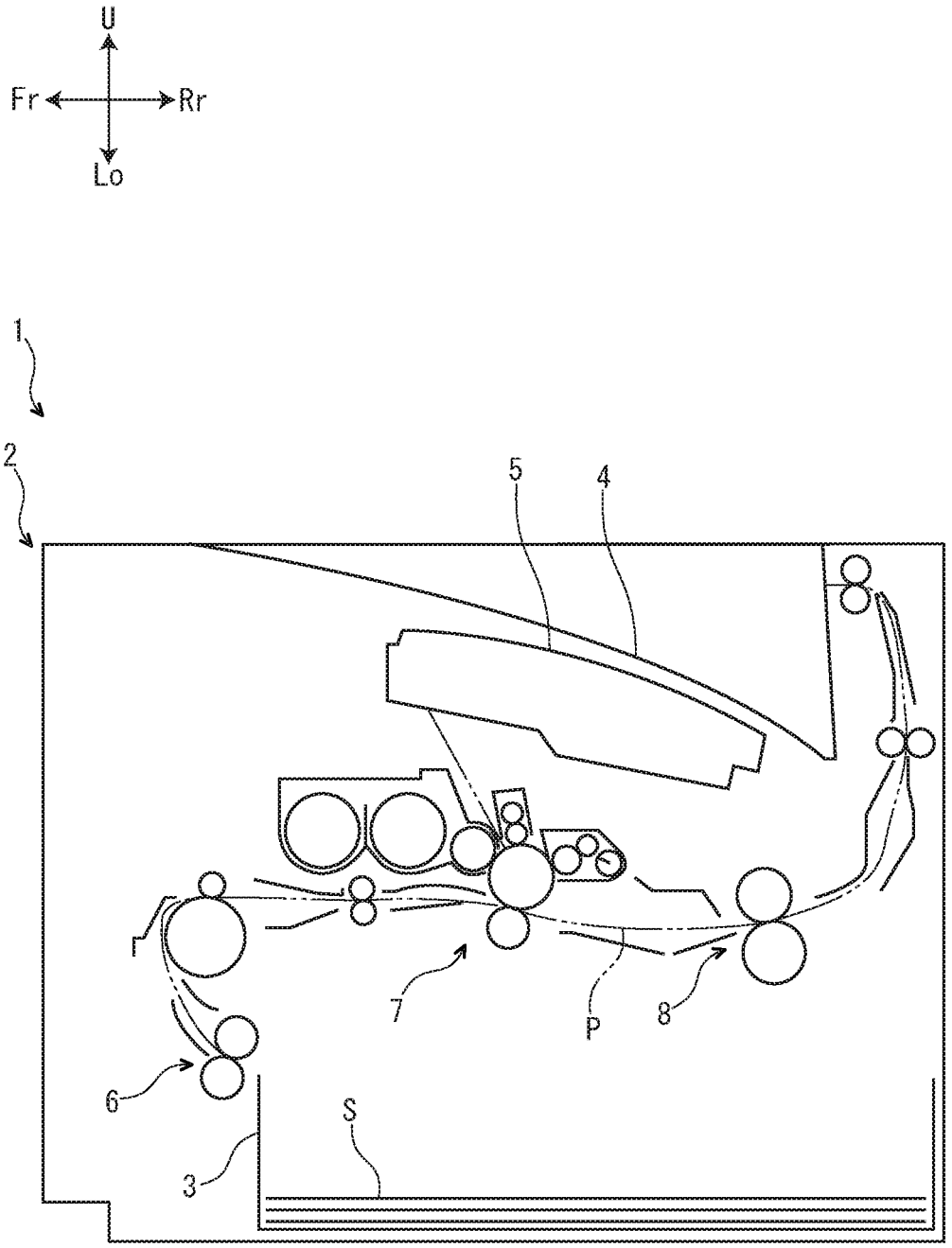
FIG. 1 is a schematic view showing an outline of an image forming apparatus according to an embodiment of the present disclosure.

Hereinafter, for convenience of explanation, a left side of FIG. 1 is defined as a front side of the image forming apparatus 1. Arrows Fr, Rr, L, R, U and Lo suitably marked in each figure respectively indicate a front side, a rear side, a left side, a right side, an upper side and a lower side of the image forming apparatus 1.

With reference to FIG. 1, the image forming apparatus 1 is a printer, for example. The image forming apparatus 1 includes a box-shaped apparatus main body 2. In a lower portion of the apparatus main body 2, a sheet feeding cassette 3 storing a sheet S (an example of a recording medium) is stored. On an upper face of the apparatus main body 2, an ejected sheet tray 4 is provided. In an upper portion of the apparatus main body 2, an exposure device 5 is stored below the ejected sheet tray 4.

Inside the apparatus main body 2, a conveyance path P for the sheet S is provided. At an upstream end portion of the conveyance path P, a sheet feeding part 6 is provided. At a midstream portion of the conveyance path P, an image forming part 7 is provided. At a downstream portion of the conveyance path P, a fixing device 8 is provided.

Next, an operation of the image forming apparatus 1 having the above described configuration will be described.

First, the exposure device 5 emits laser light (refer to a two-dotted chain line in FIG. 1) to form an electrostatic latent image at the image forming part 7. Then, the above electrostatic latent image is developed at the image forming part 7 to form a toner image. Consequently, an image forming operation is finished.

On the other hand, the sheet S fed from the sheet feeding cassette 3 by the sheet feeding part 6 is conveyed to the image forming part 7 in accordance with the above image forming operation, and the above toner image is transferred on the sheet S at the image forming part 7. The sheet S on which the toner image is transferred enters the fixing device 8, and the toner image is fixed on the sheet S at the fixing device 8. The sheet S on which the toner image is fixed is ejected on the ejected sheet tray 4.

Next, the fixing device 8 will be further described.

An arrow I suitably marked in each figure indicates an inside in a left-and-right direction of the fixing device 8 (a side close to a center in the left-and-right direction of the fixing device 8), and an arrow O suitably marked in each figure indicates an outside in the left-and-right direction of the fixing device 8 (a side separate from the center in the left-and-right direction of the fixing device 8).

Figure 2:
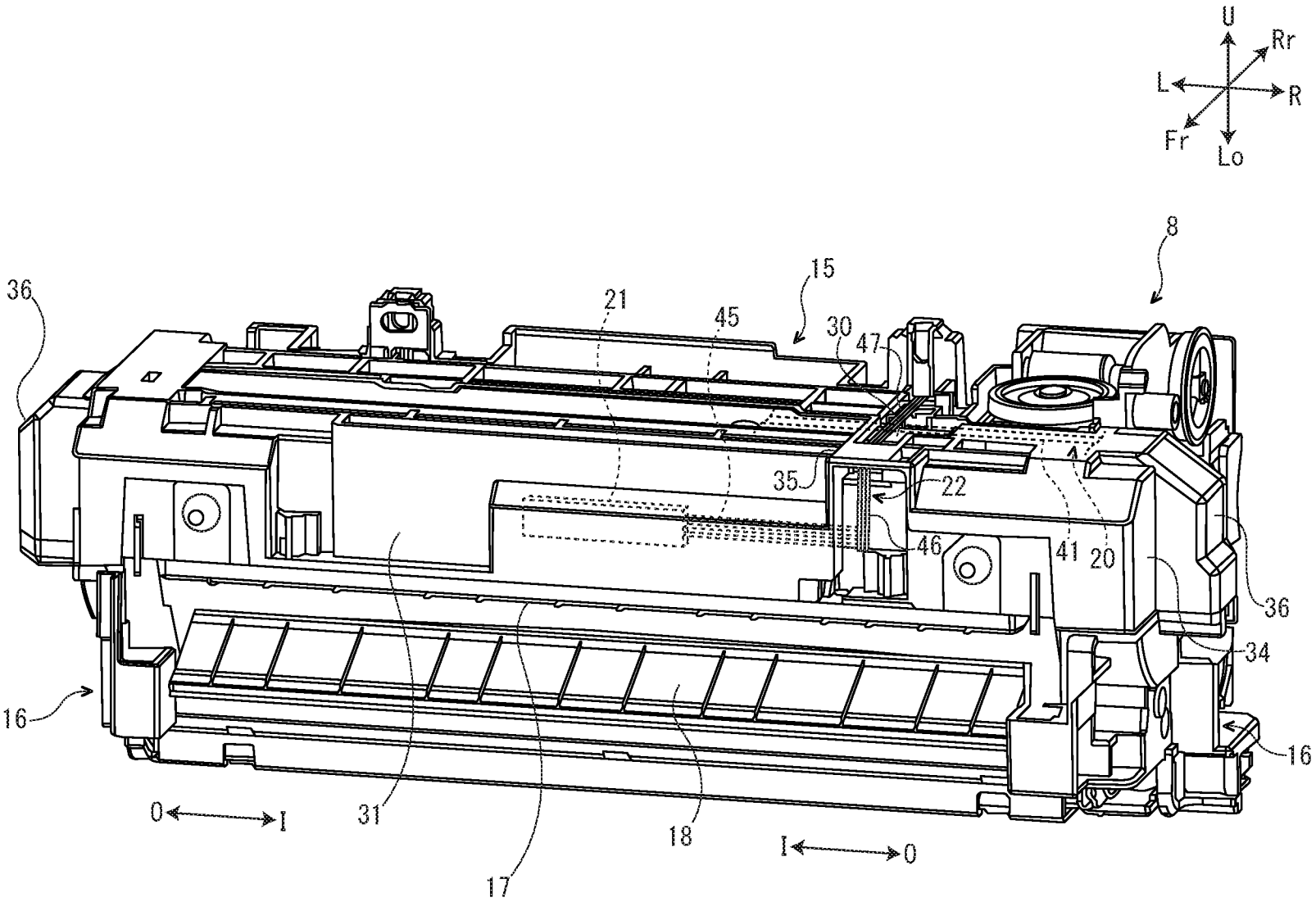
FIG. 2 is a perspective view showing a fixing device according to the embodiment of the present disclosure.

With reference to FIG. 2, the fixing device 8 has a shape elongated in the left-and-right direction. The fixing device 8 is detachably attached to the apparatus main body 2 (refer to FIG. 1).

Figure 3:
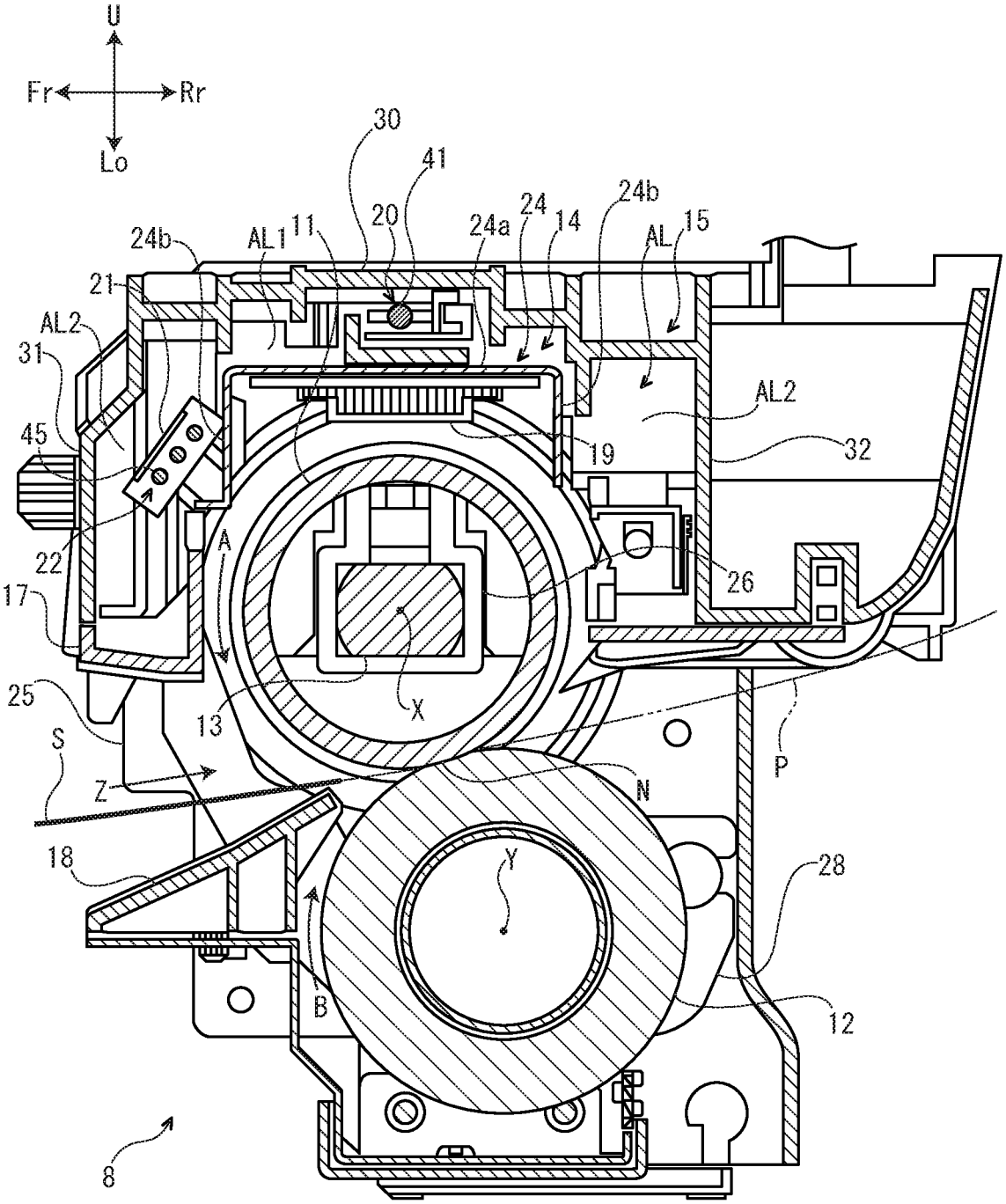
FIG. 3 is a sectional view showing the fixing device according to the embodiment of the present disclosure.
Figure 4:
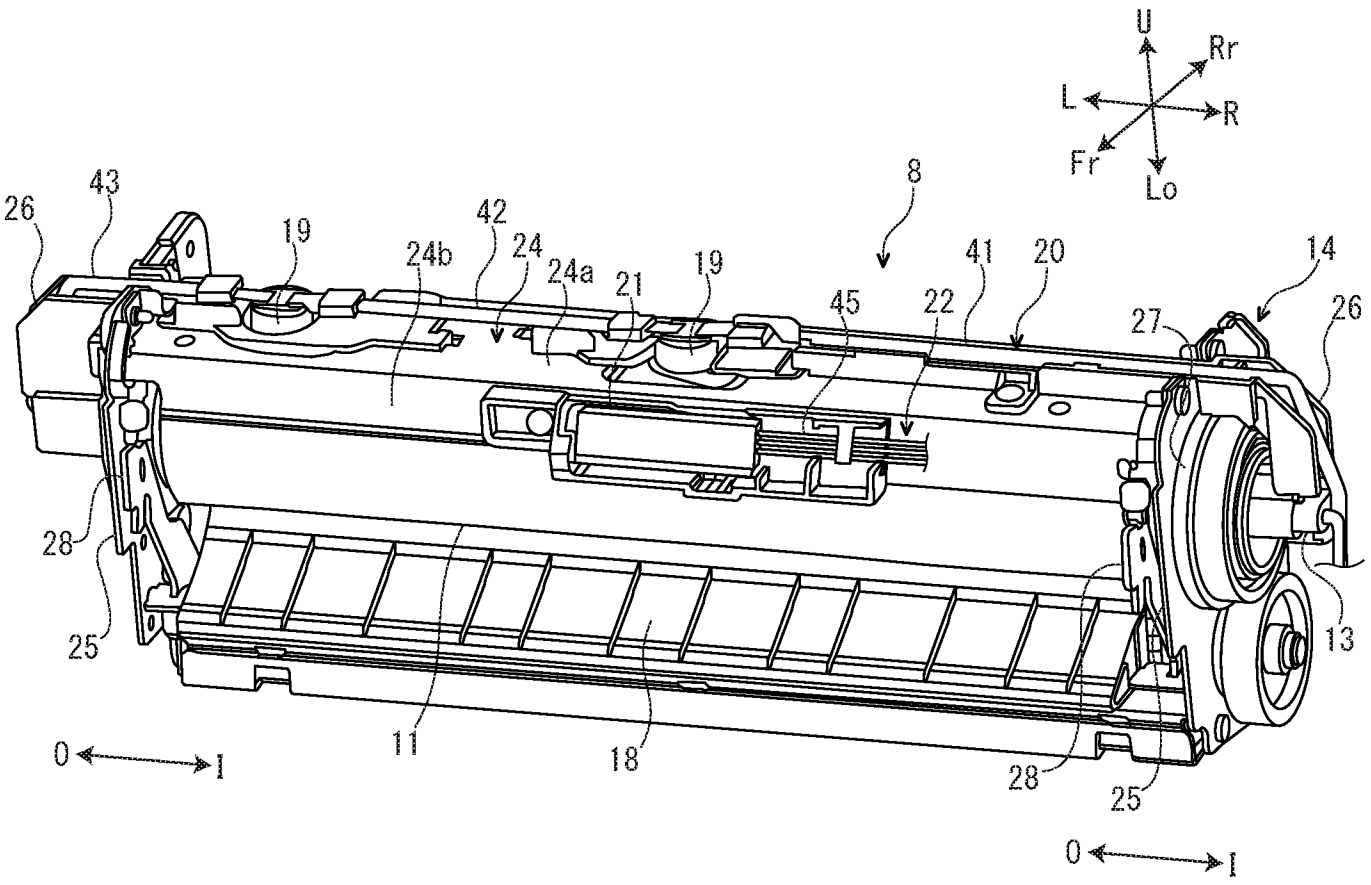
FIG. 4 is a perspective view showing a state where an upper cover and a pair of side covers are detached, in the fixing device according to the embodiment of the present disclosure.

With reference to FIG. 2 to FIG. 4, the fixing device 8 includes a fixing roller 11 (an example of a fixing member), a pressing roller 12 (an example of a pressing member) arranged below the fixing roller 11, a heater 13 stored in the fixing roller 11, a fixing frame 14 covering an upper side and both the outsides in the left-and-right direction of the fixing roller 11, an upper cover 15 covering the upper side of the fixing frame 14, a pair of side covers 16 arranged below both end portions in the left-and-right direction of the upper cover 15, an upper guide 17 arranged below a center portion in the left-and-right direction of the upper cover 15, a lower guide 18 arranged below the upper guide 17, a pair of thermal transfer cutoff elements 19 ("thermo-cut", an example of a heating stopping device) arranged above the fixing roller 11, a primary wire 20 connected to the heater 13 and the pair of thermal transfer cutoff elements 19, a temperature sensor 21 arranged at a front upper side of the fixing roller 11 and a secondary wire 22 connected to the temperature sensor 21.

With reference to FIG. 3 and FIG. 4, the fixing roller 11 of the fixing device 8 has a cylindrical shape elongated in the left-and-right direction. The fixing roller 11 rotates around a rotation axis X extending along the left-and-right direction (an example of one direction). The fixing roller 11 includes a cylindrical core material and a release layer covering an outer circumference of the core material, for example. The fixing roller 11 may include an elastic layer between the core material and the release layer.

With reference to FIG. 3, the pressing roller 12 of the fixing device 8 has a cylindrical shape elongated in the left-and-right direction. The pressing roller 12 rotates around a rotation axis Y extending along the left-and-right direction (an example of one direction). The pressing roller 12 comes into contact with the fixing roller 11 with a predetermined pressure. Thereby, a fixing nip N is formed between the fixing roller 11 and the pressing roller 12. The pressing roller 12 includes a cylindrical core material, an elastic layer provided around the core material and a release layer covering an outer circumference of the elastic layer, for example.

With reference to FIG. 3 and FIG. 4, the heater 13 of the fixing device 8 is composed of a halogen heater, for example. The heater 13 has a shape elongated in the left-and-right direction. Both end portions in the left-and-right direction of the heater 13 (the right end portion is only shown in FIG. 4) protrude to the outsides in the left-and-right direction from both end portions in the left-and-right direction of the fixing roller 11.

With reference to FIG. 3 and FIG. 4, the fixing frame 14 of the fixing device 8 includes a stay 24 extending along the left-and-right direction, a pair of side plates 25 extending downward from both end portions in the left-and-right direction of the stay 24 and a pair of supporting frames 26 arranged at the outsides in the left-and-right direction of the pair of side plates 25.

The stay 24 of the fixing frame 14 is formed by a metal plate, for example. The stay 24 has a shape elongated in the left-and-right direction. The stay 24 covers the upper side of the fixing roller 11. The stay 24 includes a base part 24*a* and a pair of bent parts 24*b* bent downward from both side portions in a front-and-rear direction of the base part 24*a*.

The pair of side plates 25 of the fixing frame 14 is formed by metal plates, for example. To upper portions of the side plates 25, bearings 27 are attached (one of the bearings 27 is only shown in FIG. 4). The pair of side plates 25 supports the fixing roller 11 via the pair of bearings 27 so that the fixing roller 11 is rotatable. On the inside in the left-and-right direction of the pair of side plates 25, a pair of pressing plates 28 is provided. The pair of pressing plates 28 supports the pressing roller 12 so that the pressing roller 12 is rotatable.

The pair of supporting frames 26 of the fixing frame 14 is formed by resin, for example. By lower end portions of the supporting frames 26, the left and right end portions of the heater 13 are supported.

Figure 5:
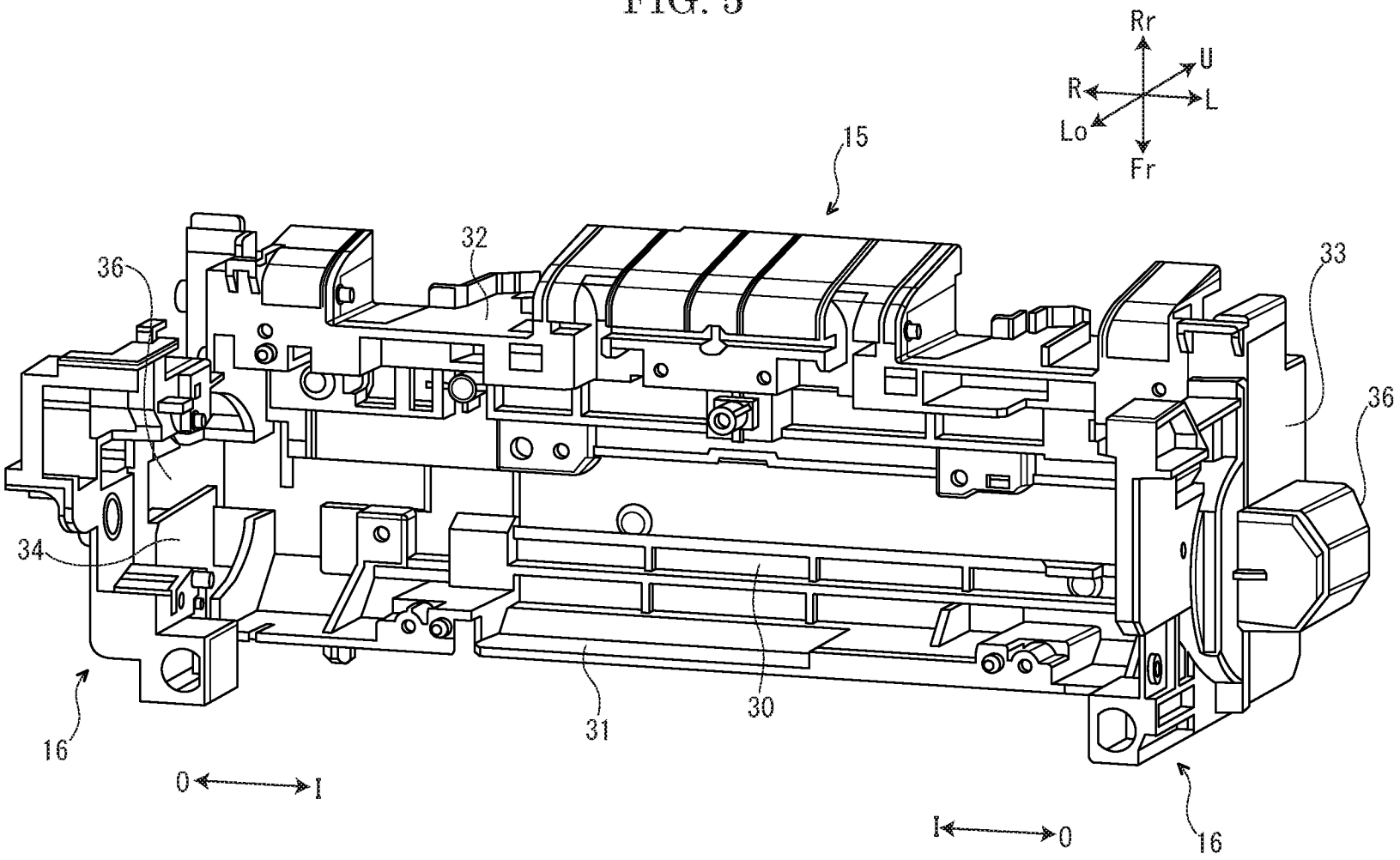
FIG. 5 is a perspective view showing the upper cover and the pair of side covers, in the fixing device according to the embodiment of the present disclosure.

With reference to FIG. 2, FIG. 3 and FIG. 5, the upper cover 15 of the fixing device 8 is formed by resin, for example. The upper cover 15 is formed in a box-like shape whose lower side is opened.

The upper cover 15 includes an upper wall 30, both front and rear side walls 31 and 32 (a front side wall 31 and a rear side wall 32) extending downward from both side portions in the front-and-rear direction of the upper wall 30, and both left and right end walls 33 and 34 (a left end wall 33 and a right end wall 34) extending downward from both end portions in the left-and-right direction of the upper wall 30.

Figure 6:
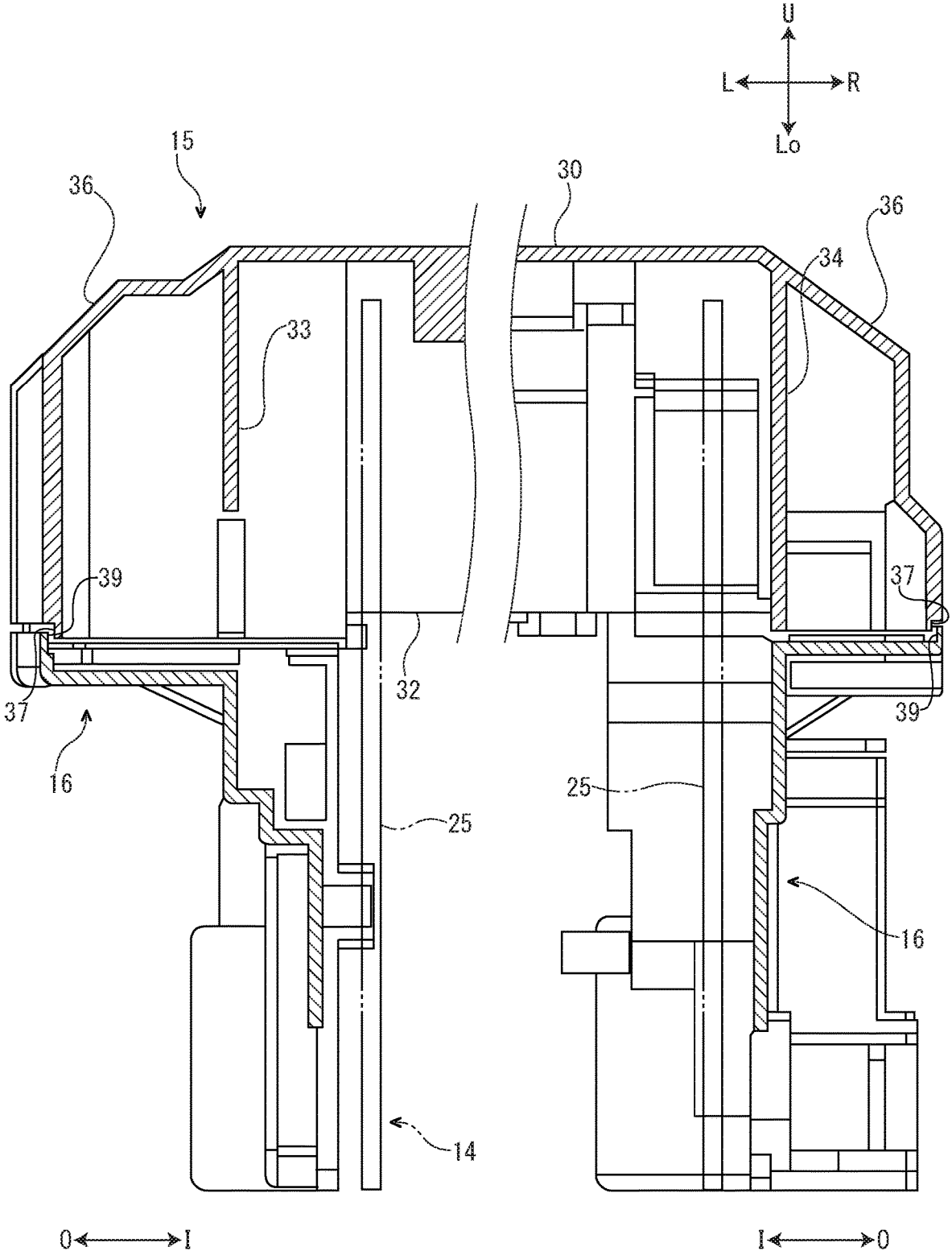
FIG. 6 is a sectional view showing the upper cover and the pair of side covers, in the fixing device according to the embodiment of the present disclosure.

The upper wall 30 of the upper cover 15 covers the upper side of the stay 24 of the fixing frame 14. On a right front portion of an upper face (an outer face) of the upper wall 30, a guide frame 35 protrudes. Both the front and rear side walls 31 and 32 of the upper cover 15 cover both the outsides in the front-and-rear direction (both outsides in a width direction) of the stay 24. Both the left and right end walls 33 and 34 of the upper cover 15 cover both the outsides in the left-and-right direction (both outsides in a longitudinal direction) of the stay 24. On both the left and right end walls 33 and 34, guide pieces 36 protrude to the outsides in the left-and-right direction. With reference to FIG. 6, on lower faces (containing lower faces of the guide pieces 36) of both the left and right end walls 33 and 34, first step parts 37 are provided.

With reference to FIG. 3, between the stay 24 of the fixing frame 14 and the upper cover 15, an air layer AL for heat insulation is formed. The air layer AL extends along the left-and-right direction, and is continuously formed from a left end side (one end side in the left-and-right direction) to a right end side (another end side in the left-and-right direction) of the stay 24. The air layer AL includes an upper layer part AL1 and a pair of lower layer parts AL2. The upper layer part AL1 is formed between the base part 24*a* of the stay 24 and the upper wall 30 of the upper cover 15. The pair of lower layer parts AL2 is formed between the pair of bent parts 24*b* of the stay 24 and both the front and rear side walls 31 and 32 of the upper cover 15. The upper layer part AL1 and the pair of lower layer parts AL2 are communicated with each other.

With reference to FIG. 5 and FIG. 6, the pair of side covers 16 of the fixing device 8 covers both the outsides in the left-and-right direction of the pair of side plates 25 of the fixing frame 14. On upper faces of the side covers 16, second step parts 39 are provided. The second step parts 39 are fitted to the first step parts 37 of the upper cover 15 by a spigot-and-socket fitting. The spigot-and-socket fitting in the embodiment shows a structure that the first step parts 37 are inserted into the insides in the left-and-right direction of the second step parts 39.

With reference to FIG. 3, the upper guide 17 of the fixing device 8 is arranged above the conveyance path P for the sheet S, and guides the sheet S, passing through the conveyance path P, from an upper side. The upper guide 17 covers a lower side of the pair of lower layer parts AL2 of the air layer AL.

The lower guide 18 of the fixing device 8 is arranged below the conveyance path P for the sheet S, and guides the sheet S, passing through the conveyance path P, from a lower side. The lower guide 18 is arranged at an upstream side of the fixing nip N in a conveyance direction Z of the sheet S.

With reference to FIG. 3 and FIG. 4, the pair of thermal transfer cutoff elements 19 of the fixing device 8 is fixed to the base part 24*a* of the stay 24 of the fixing frame 14. The pair of thermal transfer cutoff elements 19 face an outer circumferential face of the fixing roller 11. When a temperature of the outer circumferential face of the fixing roller 11 rises to a predetermined reference temperature or higher, the pair of thermal transfer cutoff elements 19 cuts off supply of electrical power to the heater 13 from a power source (not shown) and stops heating of the fixing roller 11 by the heater 13.

With reference to FIG. 3 and FIG. 4, the primary wire 20 of the fixing device 8 includes a first cable 41, a second cable 42 and a third cable 43. The first cable 41 connects the right thermal transfer cutoff element 19 to the power source (not shown). The second cable 42 connects the right thermal transfer cutoff element 19 to the left thermal transfer cutoff element 19. The third cable 43 connects the left thermal transfer cutoff element 19 to the left end portion (not shown) of the heater 13. FIG. 2 shows only an upper portion of the first cable 41 of the primary wire 20.

With reference to FIG. 3 and FIG. 4, the upper portion of the first cable 41 of the primary wire 20 extends from the right thermal transfer cutoff element 19 to the right side along the left-and-right direction. The upper portion of the first cable 41 is arranged inside the upper layer part AL1 of the air layer Al, and passes through the upper side (the outside) of the stay 24 of the fixing frame 14 and the lower side (the inside) of the upper wall 30 of the upper cover 15. A lower portion of the first cable 41 bents downward from a right end portion of the upper portion of the first cable 41. The lower portion of the first cable 41 passes through the right supporting frame 26 of the fixing frame 14, and is pulled outside the upper cover 15.

The second cable 42 of the primary wire 20 extends along the left-and-right direction. The second cable 42 is arranged inside the upper layer part AL1 of the air layer AL, and passes through the upper side (the outside) of the stay 24 of the fixing frame 14 and the lower side (the inside) of the upper wall 30 of the upper cover 15.

An upper portion of the third cable 43 of the primary wire 20 extends from the left thermal transfer cutoff element 19 to the left side along the left-and-right direction. The upper portion of the third cable 43 is arranged inside the upper layer part AL1 of the air layer Al, and passes through the upper side (the outside) of the stay 24 of the fixing frame 14 and the lower side (the inside) of the upper wall 30 of the upper cover 15. A lower portion of the third cable 43 bents downward from a left end portion of the upper portion of the third cable 43. The lower portion of the third cable 43 passes through the left supporting frame 26 of the fixing frame 14 and is connected to the left end portion of the heater 13.

With reference to FIG. 3 and FIG. 4, the temperature sensor 21 of the fixing device 8 faces the outer circumferential face of the fixing roller 11 without contact, and detects a temperature of the outer circumferential face of the fixing roller 11. The temperature sensor 21 is fixed to the front bent part 24*b* of the stay 24 of the fixing frame 14. The temperature sensor 21 is arranged inside the front lower layer part AL2 of the air layer AL.

With reference to FIG. 2 and FIG. 4, the secondary wire 22 is composed of three cables. The secondary wire 22 includes an inside passing part 45, an outside passing part 46 and a crossing part 47. The inside passing part 45 passes through the rear side (the inside) of the front side wall 31 of the upper cover 15. The outside passing part 46 passes through the front side (the outside) of the front side wall 31 of the upper cover 15. The crossing part 47 passes through the upper side (the outside) of the upper wall 30 of the upper cover 15.

The inside passing part 45 of the secondary wire 22 extends from the temperature sensor 21 to the right side along the left-and-right direction. The outside passing part 46 of the secondary wire 22 extends from a right end portion of the inside passing part 45 to an upper side along an upper-and-lower direction. The crossing part 47 of the secondary wire 22 extends from an upper end portion of the outside passing part 46 to the rear side along the front-and-rear direction. The secondary wire 22 passes through a slit (not shown) provided in the upper cover 15 at a boundary between the inside passing part 45 and the outside passing part 46. The secondary wire 22 passes though the guide frame 35 of the upper cover 15 at a boundary between the outside passing part 46 and the crossing part 47. The crossing part 47 crosses the upper portion of the first cable 41 of the primary wire 20 in a plan view. The crossing part 47 does not come into contact with the upper portion of the first cable 41 because it is isolated from the upper portion of the first cable 41 by the upper wall 30 of the upper cover 15.

Next, an operation of the fixing device 8 will be described.

When the fixing device 8 is operated, a drive source (not shown) including a motor and the others rotates the fixing roller 11 (refer to an arrow A in FIG. 3). When the fixing roller 11 is thus rotated, the pressing roller 12, which comes into contact with the fixing roller 11, is driven to be rotated in a counter direction to the rotation direction of the fixing roller 11 (refer to an arrow B in FIG. 3). When the fixing device 8 is operated, the heater 13 heats the fixing roller 11. When the sheet S enters the fixing nip N under the state, the sheet S and the toner image are heated and pressed by the fixing roller 11 and the pressing roller 12, and the toner image is fixed on the sheet S.

In the present embodiment, the air layer AL for heat insulation is formed between the fixing frame 14 and the upper cover 15. By applying such a configuration, it becomes possible to enhance a heat insulation performance of the fixing device 8 and to fix the toner image on the sheet S with a small amount of heat.

Additionally, the first to third cables 41 to 43 of the primary wire 20 pass through the inside of the upper cover 15. By applying such a configuration, the upper cover 15 does not require holes through which the first to third cables 41 to 43 of the primary wire 20 are pulled out from the inside to the outside of the upper cover 15 so that it becomes possible to reduce a number of holes formed on the upper cover 15. Accordingly, it becomes possible to inhibit heated air in the air layer Al from escaping outside the upper cover 15 and to more enhance the heat insulation performance of the fixing device 8.

Additionally, the secondary wire 22 includes the crossing part 47 crossing the first cable 41 of the primary wire 20 in a plan view, and the crossing part 47 passes through the outside of the upper cover 15. By applying such a configuration, it becomes possible for the upper cover 15 to separate the first cable 41 of the primary wire 20 from the crossing part 47 of the secondary wire 22 physically. Therefore, it becomes possible to prevent generation of signal noise owing to contact between the primary wire 20 and the secondary wire 22.

Additionally, the pair of side covers 16 covers the outsides in the left and right direction of the fixing frame 14. By applying such a configuration, it becomes possible to more enhance the heat insulation performance of the fixing device 8.

Additionally, the first step parts 37 of the upper cover 15 are fitted to the second step parts 39 of the pair of side covers 16 by the spigot-and-socket fitting. By applying such a configuration, it becomes possible to more enhance the heat insulation performance of the fixing device 8.

Additionally, the air layer AL includes the upper layer part AL1 formed between the stay 24 of the fixing frame 14 and the upper wall 30 of the upper cover 15 and the pair of lower layer parts AL2 formed between the stay 24 of the fixing frame 14 and both the front and rear side walls 31 and 32 of the upper cover 15. By applying such a configuration, compared with a case where the air layer AL includes only the upper layer part AL1 or only the pair of lower layer parts AL2, it becomes possible to increase a volume of the air layer AL and to more enhance the heat insulation performance of the fixing device 8.

Additionally, the upper guide 17 covers the lower side of the pair of lower layer parts AL2 of the air layer AL. By applying such a configuration, it becomes possible to inhibit the heated air in the air layer AL from escaping outside the upper cover 15 and to more enhance the heat insulation performance of the fixing device 8.

The image forming apparatus 1 includes the above fixing device 8. By applying such a configuration, it becomes possible to provide the image forming apparatus 1 with a high heat insulation performance.

In the spigot-and-socket fitting of the present embodiment, the first step parts 37 are inserted in the insides in the left-and-right direction of the second step parts 39. On the other hand, in the spigot-and-socket fitting of another embodiment, the second step parts 39 may be inserted in the insides in the left-and-right direction of the first step parts 37.

In the present embodiment, the fixing roller 11 is employed as the fixing member. On the other hand, in other embodiments, a fixing belt may be employed as the fixing member.

In the present embodiment, the image forming apparatus 1 is a printer. On the other hand, in other embodiments, the image forming apparatus 1 may be a copying machine, a facsimile, a multifunctional peripheral (an image forming apparatus multiply including a printing function, a copying function, a facsimile function and the others).

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A fixing device comprising:

a fixing member configured to rotate around a rotation axis extending along one direction and configured to fix a toner image on a recording medium;

a fixing frame configured to cover an upper side of the fixing member;

an upper cover configured to cover an upper side of the fixing frame;

a heater stored in the fixing member and configured to heat the fixing member;

a primary wire connected to the heater;

a temperature sensor configured to detect a temperature of the fixing member; and a secondary wire connected to the temperature sensor, wherein an air layer for heat insulation is formed between the fixing frame and the upper cover, the primary wire passes through an inside of the upper cover, the secondary wire includes a crossing part which crosses the primary wire in a plan view, and the crossing part passes through an outside of the upper cover.

2. An image forming apparatus comprising the fixing device according to claim 1.

3. A fixing device comprising:

a fixing member configured to rotate around a rotation axis extending along one direction and configured to fix a toner image on a recording medium;

a fixing frame configured to cover an upper side of the fixing member;

an upper cover configured to cover an upper side of the fixing frame; and a pair of side covers arranged below both end portions in the one direction of the upper cover and configured to cover outsides in the one direction of the fixing frame, wherein an air layer for heat insulation is formed between the fixing frame and the upper cover, first step parts are formed on lower faces of both the end portions in the one direction of the upper cover, and second step parts fitted to the first step parts are formed on upper faces of the pair of side covers.

4. The fixing device according to claim 3, wherein the first step parts are inserted into insides in the one direction of the second step parts.

5. An image forming apparatus comprising the fixing device according to claim 3.

6. A fixing device comprising:

a fixing member configured to rotate around a rotation axis extending along one direction and configured to fix a toner image on a recording medium;

a fixing frame configured to cover an upper side of the fixing member; and an upper cover configured to cover an upper side of the fixing frame, wherein an air layer for heat insulation is formed between the fixing frame and the upper cover, the fixing frame includes:

a stay configured to extend along the one direction and configured to cover the upper side of the fixing member; and a pair of side plates configured to extend downward from both end portions in the one direction of the stay and configured to support the fixing member so that the fixing member is rotatable, the upper cover includes:

an upper wall configured to cover an upper side of the stay; and a side wall configured to cover an outside in a width direction of the stay, and the air layer includes:

an upper layer part formed between the stay and the upper wall; and a lower layer part formed between the stay and the side wall.

7. The fixing device according to claim 6, further comprising:

a guide configured to cover a lower side of the lower layer part.

8. The fixing device according to claim 6, wherein the air layer extends along the one direction and is successively formed from one end side in the one direction of the stay to another end side in the one direction of the stay.

9. An image forming apparatus comprising the fixing device according to claim 6.

* * * * *